United States Patent [19]

Hogue

[11] Patent Number: 5,025,694

[45] Date of Patent: Jun. 25, 1991

[54] TUNING THE WOOD OF A MUSICAL INSTRUMENT BOW

[76] Inventor: John H. Hogue, 436 S. Saginaw St., Flint, Mich. 48501

[21] Appl. No.: 553,103

[22] Filed: Jul. 13, 1990

Related U.S. Application Data

[63] Continuation-in-part of Ser. No. 264,352, Oct. 31, 1988, Pat. No. 4,941,383.

[51] Int. Cl.[5] ..... G10D 3/16

[52] U.S. Cl. ..... 84/282

[58] Field of Search ..... 84/282

[56] References Cited

U.S. PATENT DOCUMENTS

| | | | |
|---|---|---|---|
| 485,651 | 11/1892 | Perry | 84/282 |
| 3,122,960 | 3/1964 | Stuhlen | 84/282 |

FOREIGN PATENT DOCUMENTS

| | | | |
|---|---|---|---|
| 58478 | 4/1913 | Austria | 84/282 |
| 27605 | of 1908 | United Kingdom | 84/282 |
| 433422 | 8/1935 | United Kingdom | 84/282 |

*Primary Examiner*—Lawrence R. Franklin
*Attorney, Agent, or Firm*—Charles W. Chandler

[57] ABSTRACT

A method of tuning a violin bow to improve the quality of sound consists of clamping the bow at the frog, tapping the bow near the frog, and trimming the material in the proximity of the tapping point until a desired tone is produced by the vibrating bow. The bow is subsequently clamped at the previous tapping point, and the tapping and trimming steps are repeated. This process is continued until the head end of the bow is reached.

7 Claims, 1 Drawing Sheet

TUNING THE WOOD OF A MUSICAL INSTRUMENT BOW

This application is a continuation-in-part of patent application, Ser. No. 264,352, entitled METHOD FOR TUNING A VIOLIN, filed 12/31/88 now U.S. Pat. No. 4,941,383 which is incorporated by reference herein, including the specification, drawings, and prior art references.

TECHNICAL FIELD

The present invention relates to a method for tuning bows, for use with stringed instruments, where the material used to make the bow is controllably thinned to a selected pitch or tone to improve the sound and performance of the bow during use.

BACKGROUND ART

There has been some disagreement among authorities as to how to improve the quality of the sound of a string instrument, such as a violin. Some experts attribute sound quality to the selection of the wood used during fabrication of the violin, others to the skill in shaping the wood to the desired shape and thickness to achieve the desired sound, still others to the finish applied to the instrument after fabrication.

In my patent application referenced above, I disclose a method for tuning new or used violins to improve the quality of the sound, wherein the selected wood material is first shaped so that the overall thickness is slightly greater than the desired finished thickness. The material is then firmly held and tapped to determine the existing sound. Tapping is first done around the periphery of the material, and material is selectively removed in proximity to the area being tapped, to adjust the audible sound of the wood to a desired pitch over substantially its entire surface, and thus to improve the quality of the sound of the instrument. The material is selectively tuned from the peripheral edge towards the center of the instrument, and the instrument made therefrom resonates at the selected pitch to produce the desired tonal quality.

A finished stringed instrument may be fine tuned by selective material removal to achieve the optimum tonal quality for the selected instrument. Where a finished instrument is tuned, the material may be scrapped on the inside of the The bow, the bridge, and the bass bars sound bars of a violin, guitar or other stringed instrument may also be tuned in a similar manner. The present application is directed to a more specific teaching of the preferred embodiment of a method of bow tuning, as more completely disclosed in the specification, drawings and claims disclosed herein.

DISCLOSURE OF THE INVENTION

This invention provides a method of tuning a new or existing bow, such as a violin bow, by selective material removal to achieve a desired pitch, or selected range of pitch, along the length of the bow. The bow frog, or handle, is first secured in a padded vice, or suitable clamping means to avoid scratching or marring the surface of the frog, and to rigidly secure the frog in the vice.

Preferably, the bow extends in a generally horizontal direction from the vice for ease of handling, tapping and material removal.

Once the bow has been secured in a suitable clamping means, the bow is tapped near the frog, or handle, to first determine the audible sound of the bow, and then material is selectively removed in proximity to the tapped portion of the bow to adjust the audible sound of the tapping until the desired pitch is achieved.

With the frog secured in the clamping means, a single audible sound will be heard along the entire length of the bow. To tune the bow, the bow is reclamped at the previous tapping location, and tapped at a new location in proximity to the previous location, further from the frog. As the length of the free end of the bow is foreshortened due to reclamping the bow at a location closer to the tip, the audio sound, or pitch raises.

Material is selectively removed, preferably by scraping the bow with a sharp implement, until the entire length of the bow has been properly tuned to the desired pitch or range of pitches.

PREFERRED EMBODIMENT OF THE INVENTION

Figure 1:
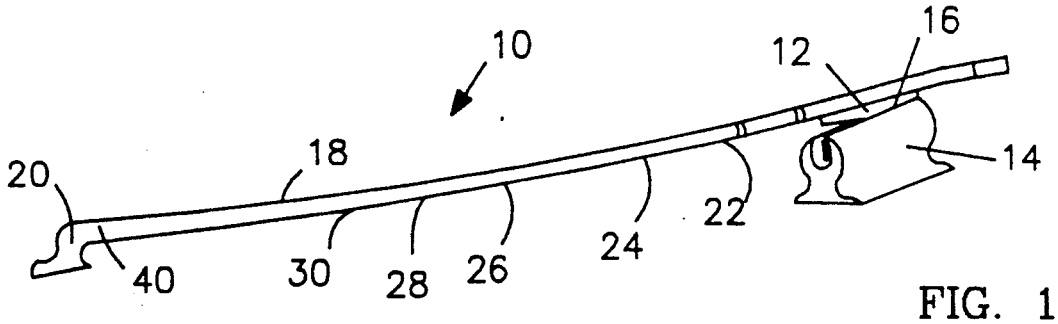
FIG. 1 is a perspective view of a bow, with the frog clamped in a vice.
Figure 2:
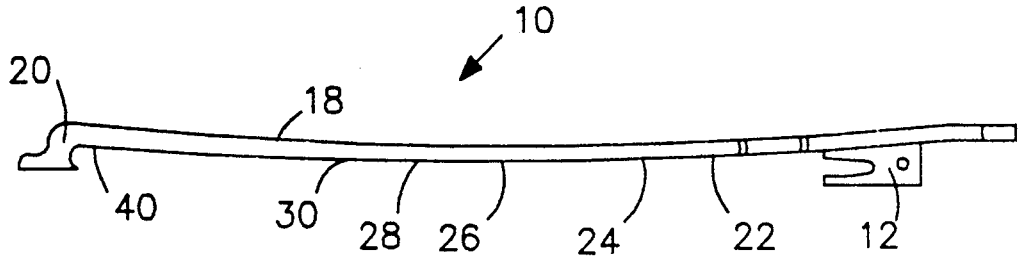
FIG. 2 is a side view of the bow showing the preferred tapping locations, starting nearest the frog, and progressively extending towards the tip of the bow.
Figure 3:
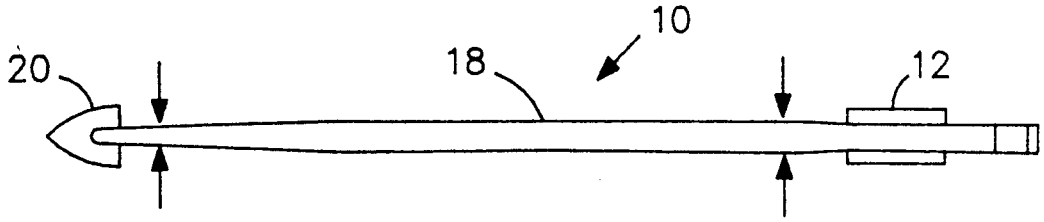
FIG. 3 is a top view of the bow, showing the tapered condition of the bow when the bow has been properly tuned in accordance with the disclosed invention.
Figure 4:
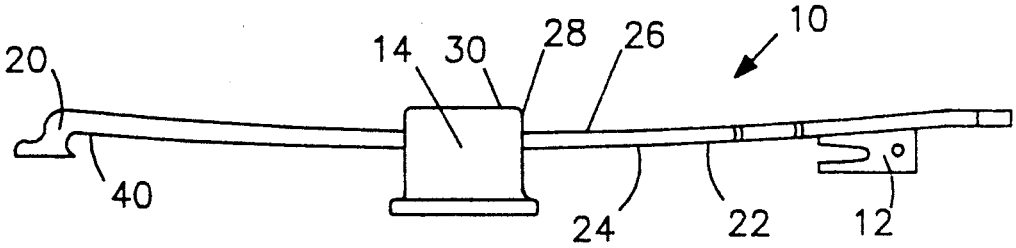
FIG. 4 is a side view of the bow, with the bow clamped near the middle of the bow.

Referring now to FIG. 1, the bow 10 is first secured at the frog, or handle 12 by a vice, or other known clamping means 14, having a protective material 16, preferably leather, disposed between the bow 10 and the clamping means. The body of the bow 18 preferably extends in a substantially horizontal direction from the clamping means, for ease of progressive tapping and material removal.

A standard violin bow 10 is about 28 ½ inches long from the frog 12 to the tip 20.

Preferably bow 10 is about 5/16 inches thick near frog 12, about ⅜ inches thick at a point 9 inches from the frog, and about 3/16 inches thick at the tip.

Once the bow 10 is clamped at a first location 22 at the frog 12, the bow is manually tapped near the frog 12 to determine the existing audio sound of the bow 10. Material is then selectively removed from the proximity of the first tapped location by scraping the bow with a sharp instrument. (Not shown).

Work proceeds cautiously until the desired pitch at the first tapping location 22 is achieved. Preferably, a "D" note, or a "D-Flat" note is selected at the first tapping location.

Removal of too much material from the body 18 of the bow 10 will damage the bow, and no known means exists to add material to the bow 10 to substantially replace the material removed, without damage to the pitch, or sound quality of the bow.

Thus, the pitch or tone of a bow may be adjusted by selective removal of material from the bow 10. By working from the frog towards the tip of the bow, the bow may be properly tuned to a desired pitch, along the entire length of the bow 10.

It has been found that a properly tuned bow 10 does not substantially change pitch when a finish coat, such as varnish, is applied to the bow 10.

Once the desired pitch is achieved at the first tapping location 22, the craftsman moves the bow 10 about one to two inches in the clamping means 14 and proceeds to a second tapping location 24, about one to two inches towards the tip 20 from the first tapping location 22, where a second desired pitch is selected. The pitch changes due to the reclamping which foreshortens the free length of the bow extending from the clamping means.

Assuming that whole notes are selected, the second desired pitch will preferably be an "E" pitch. The bow 10 is alternately tapped and selectively scraped to adjust the pitch of the bow 10 at the second tapping location 24 to achieve the desired "E" pitch.

The procedure is repeated as the bow 10 is secured in the vice 14 at the second tapping location 24, and the third tapping location 26 is selected, wherein the desired pitch is preferably an "F" pitch, and the tapping and scraping is continued until an "F" pitch is achieved at the third tapping location.

The procedure is then repeated at the fourth tapping location 28 to achieve a "G" pitch. This continues until the last note or tone, such as a "high C" pitch is preferably tuned at a location 40 about four inches from the tip 20 of the bow 10.

The bow 10 may be reclamped at the frog 12 to confirm that the desired pitch has been achieved over the entire length of the bow.

Once the bow 10 has been properly tuned to the desired pitch as noted above, and properly strung, the bow 10 will exhibit the desired tonal quality throughout its entire range of use, from near the frog 12, to near the tip 20, and at all locations therebetween.

Once properly tuned, a finish, such as varnish lacquer or shellac may be applied to the bow without adversely affecting the tonal quality of the bow.

Therefore, while this invention has been described with reference to a particular embodiment, it is to be understood that modifications may be made without departing from the spirit of the invention, or from the scope of the following claims.

INDUSTRIAL APPLICABILITY

This invention is directed to a method for tuning bows for stringed instruments, such as violins, to improve tonal quality of the bow or bridge during use.

I claim:

1. A method of manufacturing and tuning a bow for a stringed instrument, comprising the steps of:

a) forming the bow to a predetermined size and shape, having a frog disposed at one end and a tip disposed at the opposite end, with a thicker cross sectional bow configuration near the frog, and a thinner cross section bow configuration near the tip;

b) securing the frog in a suitable clamping means;

c) tapping the surface of the bow at a first location near the frog to determine the audible sound of the bow at the location tapped;

d) selectively removing the material from the bow in proximity to the tapping location to adjust the audible sound of the bow to the desired pitch;

e) progressively reclamping the bow at the previous tapping location, and selectively removing material in proximity to a newly selected tapping location to adjust the audible sound to the desired pitch until the substantial length of the bow has been progressively tapped and material selectively removed to achieve the desired audible sound along substantially the entire length of the bow.

2. The method of claim 1, wherein the clamping means includes a resilient material disposed between the bow and the clamping means to avoid scratching and damaging the bow portion subjected to pressure from the clamping means.

3. The method of claim 2, wherein the resilient material disposed between the bow and the clamping means is a strip of leather secured to the clamping means on each side of the bow.

4. The method of claim 1, wherein the material is selectively removed by scraping the bow surface with a sharp implement.

5. The method of claim 1, wherein the bow is selectively tuned to extend in substantially whole notes from a "D" or "D flat" near the frog to a "high-C" near the tip of the bow, as the bow is progressively clamped by the clamping means at selected locations along the length of the bow, and the bow is tapped to produce an audible sound.

6. The method of claim 5, wherein each successive whole note is selectively tuned to be about one to two inches apart along the length of the bow, with the pitch rising as the bow is foreshortened between the clamping means and the tip of the bow.

7. The method of claim 1, wherein the bow is clamped in a substantially horizontal position for ease of handling, tapping and selective material removal.

* * * * *